United States Patent [19]

Omori et al.

[11] Patent Number: 4,464,042

[45] Date of Patent: Aug. 7, 1984

[54] DEVICE FOR GUIDING A RECORDING PAPER

[75] Inventors: Kazuo Omori; Hiroshi Tsuchiya; Yoshio Yamazaki; Shigeru Inowa, Tokyo, all of Japan

[73] Assignee: Konishiroku Photo Industry Co., Ltd., Tokyo, Japan

[21] Appl. No.: 404,548

[22] Filed: Aug. 2, 1982

[30] Foreign Application Priority Data

Aug. 10, 1981 [JP] Japan ..... 56-124106

[51] Int. Cl.[3] ..... G03G 15/00

[52] U.S. Cl. ..... 355/3 SH; 355/14 SH

[58] Field of Search ..... 355/3 SH, 14 SH, 72; 271/228, 251, 227, 248, 250, 253, 254; 226/15, 19, 20, 199

[56] References Cited

U.S. PATENT DOCUMENTS

| | | | |
|---|---|---|---|
| 4,072,412 | 2/1978 | Suda et al. | 355/3 TR |
| 4,298,270 | 11/1981 | Tsuda et al. | 355/3 SH |
| 4,334,759 | 6/1982 | Clausing | 355/3 SH |

*Primary Examiner*—A. C. Prescott

*Attorney, Agent, or Firm*—James E. Nilles

[57] ABSTRACT

A device for guiding a recording paper, which comprises a guide member pivoted to a fixed portion of the device to guide the recording paper to a transfer position, the guide member being urged to rotate in one direction. A reference surface for determining the position of end portion of the guide member in the direction of being fed the paper is formed in the fixed portion of the device. The reference surface has a radius of curvature which is slightly greater than the outer diameter of a photosensitive drum and a center of curvature which is in agreement with the center of said photosensitive drum.

7 Claims, 3 Drawing Figures

DEVICE FOR GUIDING A RECORDING PAPER

BACKGROUND OF THE INVENTION

1. Field of the Invention

The present invention relates to a device for guiding recording papers, which works to restrict moving directions of the recording papers in the copying machines and in the printing machines.

2. Description of the Prior Art

In supplying recording papers onto the periphery of a photosensitive drum on which the toner image has been formed in an electrophotographic reproducing machine, any clearance between the peripheral surface of the photosensitive drum and the recording paper makes it difficult to correctly transfer the toner image onto the recording paper as has been widely known. Therefore, strict precision is required for the clearance between the photosensitive drum and the tip of a guide plate which supplies the recording papers onto the peripheral surface of the photosensitive drum. According to the conventional devices, therefore, the guide plate is adjustably mounted on the fixed portion of the apparatus by such position-adjusting means as elongated holes or the like, and the distance between the tip of the guide plate and the peripheral surface of the photosensitive drum is determined by using a gauge in the assembling steps. With such a guide device, however, the adjusting operation must be carried out for the individual machines. Further, the adjusting operation which is carried out in narrow space impairs the operation efficiency and reduces the mass-production efficiency.

To eliminate the above-mentioned defects, a method has been proposed in Japanese Patent Laid-Open No. 135,875/1980 that was laid open to public inspection. According to this method, provision is made of a rotary portion that comes into contact with both ends of the photosensitive drum where no image is formed, and a guide shaft which is formed together with the rotary portion as a unitary structure maintaining a predetermined clearance relative to the surface of the photosensitive drum, thereby to guide the transfer papers. This method is capable of defining a clearance that is effective for enhancing the transfer effects. However, since end portion of the guide shaft comes into contact with the surface of the photosensitive drum to rotate, the shaft is subject to be worn out when the copying operation is carried out at high speeds, or the toner infiltrates into the bearings and the shaft fails to rotate smoothly. Consequently, part of the rotary portion is rubbed by the surface of the photosensitive drum and is worn out.

SUMMARY OF THE INVENTION

In order to eliminate the above-mentioned defects as well as to eliminate problem associated with the adjustment of paper-guide device, the present invention provides a device for guiding recording papers, which does not require adjustment and which, when the recording papers are jammed, is capable of quickly eliminating the jammed state.

Further objects and features of the invention will become obvious from the following description taken in conjunction with the accompanying drawings.

DESCRIPTION OF THE PREFERRED EMBODIMENTS

Figure 1:
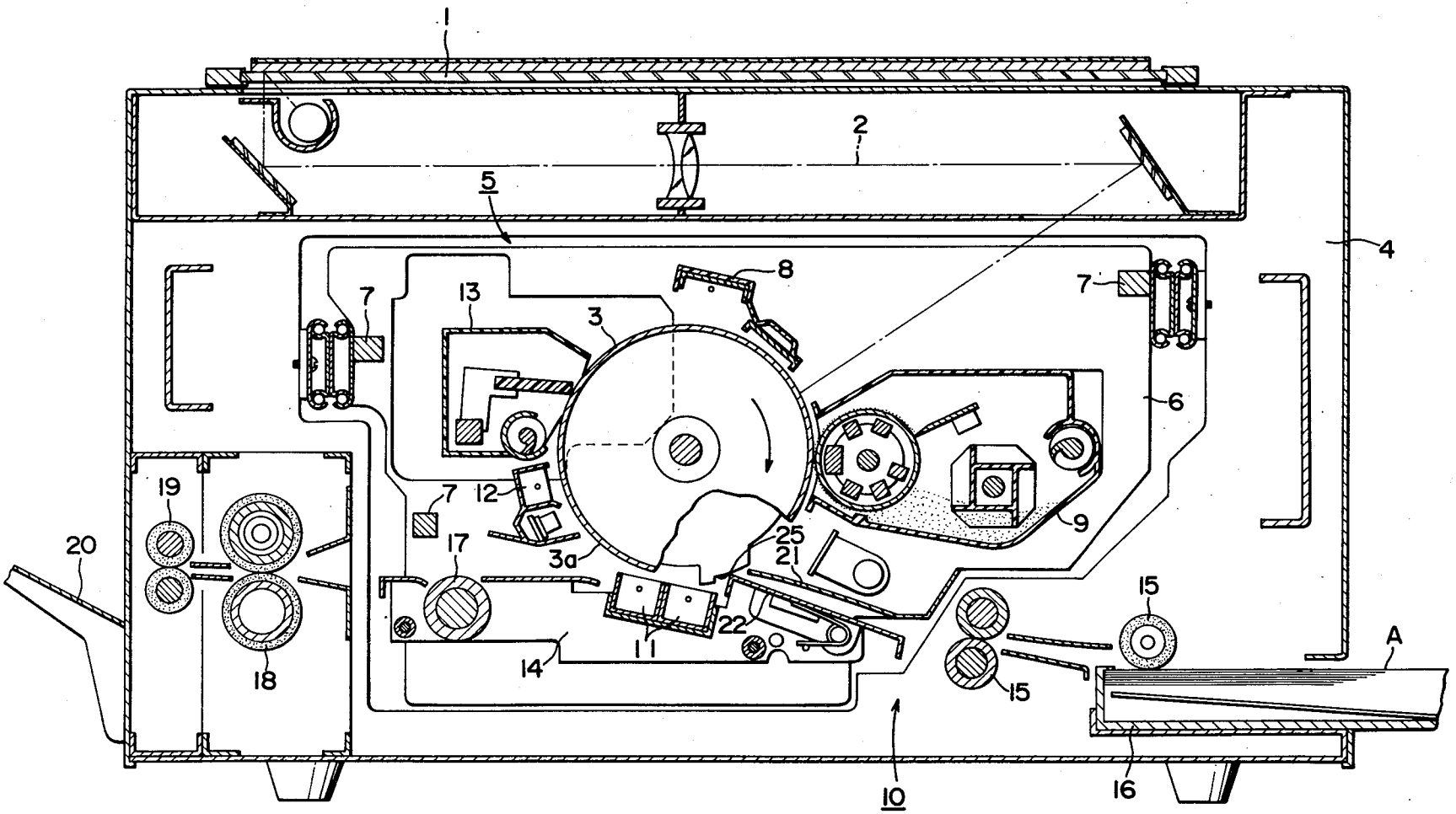
FIG. 1 is a sectional view showing a whole electrophotographic copying machine to which the present invention is adapted.

FIG. 1 is a sectional view of an electrophotographic copying machine, in which the image of an original on a document glass plate 1 is focused on the peripheral surface of a photosensitive drum 3 through a slit exposure system 2. The photosensitive drum 3 is rotatably supported by a mounting frame 5 which can be drawn from a machine housing 4 in a direction at right angles with the surface of the drawing. The mounting frame 5 consists of a pair of side plates 6 that are opposed to each other in a direction at right angles with the surface of FIG. 1, and a plurality of spacing rods 7 that connect the side plates 6.

Figure 3:
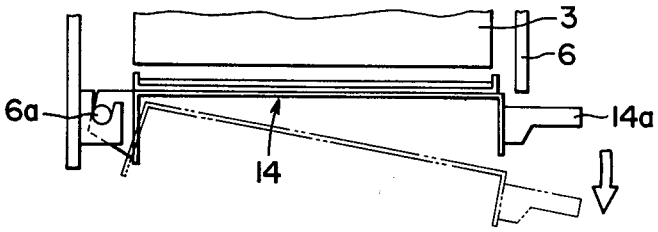
FIG. 3 is a top view of FIG. 2.

Around the periphery of the photosensitive drum 3, there are provided a charging electrode 8, a developing device 9, a recording paper guide device 10 constructed according to the present invention, a transferring and separating electrode 11, a charge eliminating electrode 12, and a cleaning device 13 successively in the rotating direction of the drum. Both ends of each of the charging electrode 8, developing device 9, charge eliminating electrode 12, and cleaning device 13, are detachably supported by the side plates 6. The recording paper guide device 10 and the transferring and separating electrode 11 are mounted on an auxiliary frame 14 that is swinably pivoted by the side plates 6. In case the papers are jammed, a stop mechanism which is not shown is released so that the frame 14 is allowed to turn with a pivot shaft **6*a* installed on the side plates 6 as a center as shown in FIG. 3. Namely, the frame 14 is separated from the photosensitive drum with the pivot shaft 6*a* as a center, so that the clogged paper can be easily treated. For this purpose, space is formed under the photosensitive drum. A grip 14*a* is provided on the other side of the frame 14. The recording papers A contained in a paper feeding cassette 16 are supplied one piece by one piece to the recording paper guide device 10 by the function of a paper feeding roller 15. The recording paper A to which the toner image is transferred is sent to a fixing device 18 by a conveyor roller 17, and is ejected on a paper ejecting tray 20 by a paper ejecting roller 19**.

Figure 2:
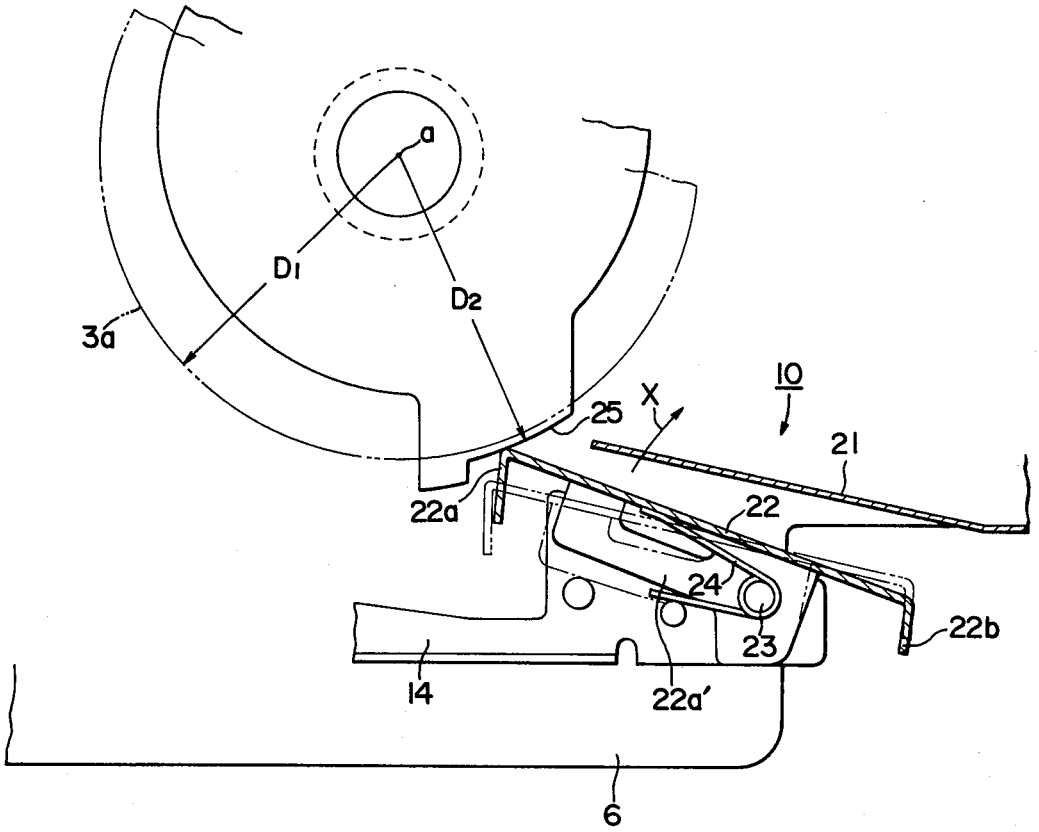
FIG. 2 is a view showing a major portion of the copying machine on an enlarged scale.

FIG. 2 shows, in detail, the recording paper guide device according to the present invention, which has an upper guide plate 21 directly fastened to the side plates 6, and a lower guide plate 22 as a guide member pivoted by the auxiliary frame 14. That is, brackets **22*a*' folded at right angles are formed on both sides of the lower guide plate 22, and are pivoted by a pivot shaft 23 that is supported by the auxiliary frame 14. The lower guide plate 22 is urged to turn in the direction of arrow X by a spring 24 that is fitted to the pivot shaft 23. On the other hand, a reference surface 25 for positioning is formed on the inner surface of the side plates 6, the reference surface 25 having a radius $D_2$ of curvature which is slightly greater than the outer diameter $D_1$ of the photosensitive drum 3 as an image receptor and having a center a of curvature which is in agreement with the center of the photosensitive drum 3. The reference surface can be formed very precisely with reference, for example, to the axis of the drum. The tip 22***a* of the lower guide plate 22 comes into collision with the reference surface 25 for positioning being urged by the spring 24.

The device for guiding recording papers according to the embodiment of the present invention is constructed as mentioned above. That is, since the machining error between the reference surface 25 for positioning and the peripheral surface 3*a* of the photosensitive drum 3 can be reduced to a negligible degree, relation between the tip 22*a* of the lower guide plate 22 and the peripheral surface 3*a* of the photosensitive drum 3 can be maintained in a strictly specified state without requiring any adjustment. Further, in case the recording paper A is caught between the peripheral surface 3*a* of the photosensitive drum 3 and the tip 22*a* of the lower guide plate, the frame 14 is retracted as mentioned earlier, and the paper is treated by utilizing space formed under the photosensitive drum. In this case, since the lower guide plate 22 retracts together with the frame 14, the recording paper A can be easily removed. After the recording paper A is removed, the frame 14 is allowed to return to the initial position. The lower guide plate also returns from the retracted position, and comes into collision with the reference surface 25 for positioning; therefore, the specified clearance is easily restored with respect to the photosensitive drum. In the above-mentioned embodiment, the end of the lower guide plate 22 is permitted to come into direct collision with reference surfaces 25 for positioning. It is, however, allowable to provide the support shaft 23 with a lever, fasten the lower guide plate 22 to the support shaft 23, and to bring the lever into contact with any other reference surface.

Although the above embodiment has dealt with the case of guide plates provided for the photosensitive drum, the present invention is in no way limited thereto but can further be adapted to any other guide devices for recording papers that require strict positioning.

Thus, the device for guiding recording papers according to the present invention can be mass-produced without requiring any adjustment during the assembling steps. Further, the recording paper which is caught by the device for guiding recording papers can be easily removed. Moreover, clearance between the photosensitive drum and the guide plate can be maintained precisely.

What is claimed is:

1. A copying machine comprising a photosensitive drum; a charging electrode for charging the surface of said photosensitive drum; an exposure system for focussing an image on the surface of said photosensitive drum; a developing device for said image; a transferring electrode for transferring a toner image to a recording paper; a separating electrode for separating said recording paper carrying the toner image from said drum; and a device for guiding a recording paper which comprises a guide member pivoted to a fixed position of said device to guide the recording paper to a transfer position and urged to rotate in one direction, and a reference member on a fixed portion of said device to determine the position of an end portion of said guide member in the direction of feeding the paper.

2. In a copying machine, in combination:

an image receptor (3) having a surface (3*a*) on which an image is formable;

a component comprising a reference surface (25) having a predetermined fixed position with respect to said surface (3*a*) of said image receptor (3);

and a device (10) for guiding recording paper to an area for transferring an image on said image receptor (3) to said recording paper, said device comprising a movable guide member (22) and means (24) for biasing said movable guide member (22) against said reference surface (25) so that said guide member (22) assumes a precise predetermined clearance distance with respect to said surface (3*a*) of said image receptor (3).

3. A copying machine according to claim 2 wherein said device (10) with said movable guide member (22) thereon is selectively movable between a predetermined position relative to said image receptor (3) and another position away from said image receptor (3).

4. In a copying machine, in combination:

a mounting frame (5);

an image receptor (3) supported on said mounting frame (5) and having a surface (3*a*) on which an image is formable;

a component mounted on said mounting frame (5) and comprising a reference surface (25) having a predetermined fixed position with respect to said surface (3*a*) of said image receptor (3);

and a device (10) supported on said mounting frame (5) in a predetermined position relative to said image receptor (3) for guiding a recording paper (A) to an area for transferring an image on said image receptor (3) to said recording paper (A), said device (10) being selectively movable between said predetermined position and another position away from said image receptor (3), said device (10) comprising a movable guide member (22) and means (24) for biasing said movable guide member (22) against said reference surface (25) when said device (10) is in said predetermined position so that said guide member (22) assumes a precise predetermined clearance distance with respect to said surface (3*a*) of said image receptor (3).

5. A copying machine according to claims 1 or 2 or 3 or 4 wherein said device (10) comprises an auxiliary frame (14) on which said guide member (22) is movably mounted.

6. A copying machine according to claim 5 wherein said image receptor (3) comprises a cylindrical surface (3*a*) having a center of curvature (a) and a predetermined radius of curvature ($D_1$) and wherein said reference surface (25) is curved and has the same center of curvature (a) as said cylindrical surface (3*a*) but has a slightly larger radius of curvature ($D_2$) than said predetermined radius of curvature ($D_1$).

7. A copying machine according to claim 2 or 3 or 4 wherein said image receptor (3) comprises a cylindrical surface (3*a*) having a center of curvature (a) and a predetermined radius of curvature ($D_1$) and wherein said reference surface (25) is curved and has the same center of curvature (a) as said cylindrical surface (3*a*) but has a slightly larger radius of curvature ($D_2$) than said predetermined radius of curvature ($D_1$).

* * * * *